United States Patent [19]

Tyner

[11] 4,266,514

[45] May 12, 1981

[54] INTAKE MANIFOLD SYSTEM FOR A TWO-CYCLE V-ENGINE

[75] Inventor: Alfred E. Tyner, Fond du Lac, Wis.

[73] Assignee: Brunswick Corporation, Skokie, Ill.

[21] Appl. No.: 64,121

[22] Filed: Aug. 6, 1979

[51] Int. Cl.[3] ..... F02B 25/28

[52] U.S. Cl. ..... 123/55 R; 123/59 B; 123/73 R; 123/73 A

[58] Field of Search ..... 123/55 R, 55 VF, 55 VS, 123/55 VE, 55 V, 73 A, 73 R, 73 PP, 59 B

[56] References Cited

U.S. PATENT DOCUMENTS

| | | | |
|---|---|---|---|
| 3,269,374 | 8/1966 | Conover | 123/73 A X |
| 3,851,631 | 12/1974 | Kiekhaefer | 123/55 R |

*Primary Examiner*—Wendell E. Burns

*Attorney, Agent, or Firm*—O. Thomas Sessions

[57] ABSTRACT

The inlet manifold for a V-6, two-cycle outboard motor engine is arranged with one inlet passage for each cylinder. The inlet passages form a V with each passage substantially in line with the cylinder it feeds, but sloping downward.

10 Claims, 3 Drawing Figures

INTAKE MANIFOLD SYSTEM FOR A TWO-CYCLE V-ENGINE

BACKGROUND OF THE INVENTION

This invention relates to an internal combustion engine and particularly to an intake manifold and valve arrangement for a large two-cycle crankcase compression V-engine for use in outboard motors.

To design an engine larger than existing engines, it is impractical to simply increase the size of prior, smaller engines. Certain components such as reed valves are not amenable to a simple increase in size. Thus a new, larger, two-cycle engine requires a different intake arrangement than that of the prior art.

SUMMARY OF THE INVENTION

A multiple cylinder two-cycle outboard motor engine has a plurality of cylinders arranged in a V with a crankcase defined at the bottom of the V, the crankcase being divided into crank chambers, one for each cylinder. A vertical crankshaft is connected to be driven by pistons reciprocating in the cylinders with the crank chambers subjected to compression and expansion as the pistons reciprocate. A plurality of inlet passages for air-fuel mixture, one for each of the crank chambers, are arranged in two vertical banks forming a V.

DESCRIPTION OF THE PREFERRED EMBODIMENT

Figure 1:
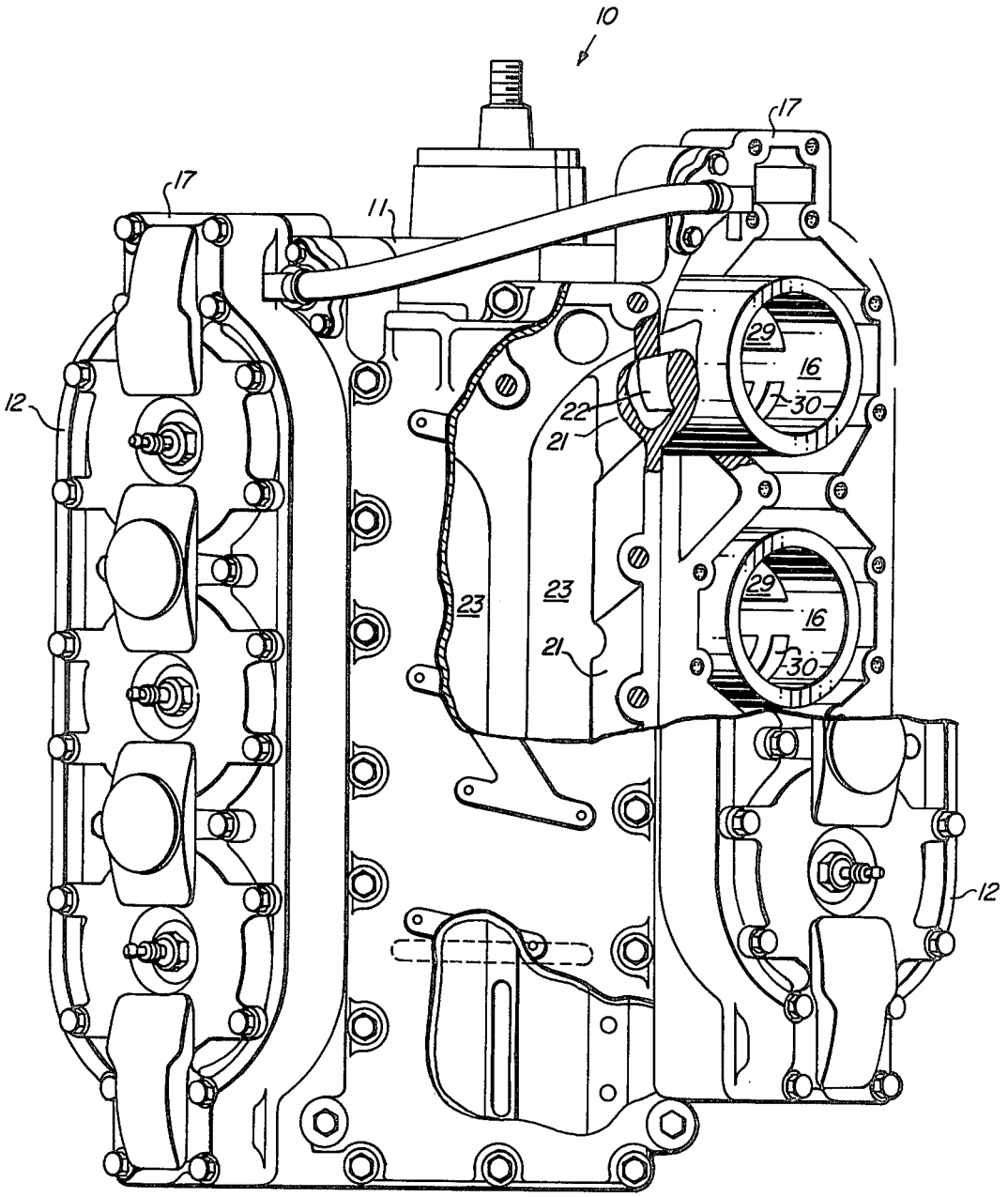
FIG. 1 is a broken away rear view of an engine.
Figure 2:
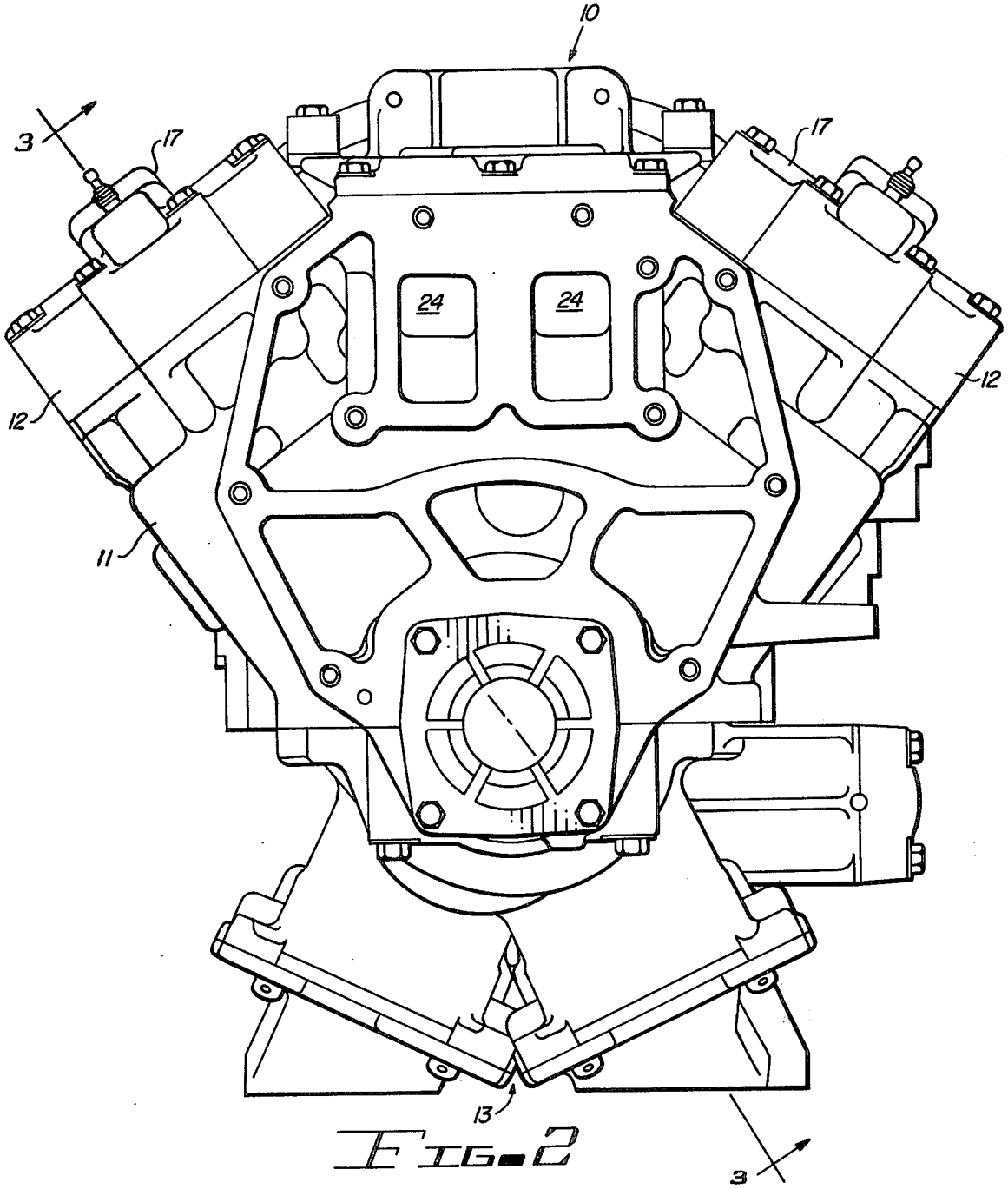
FIG. 2 is a bottom view of the engine.
Figure 3:
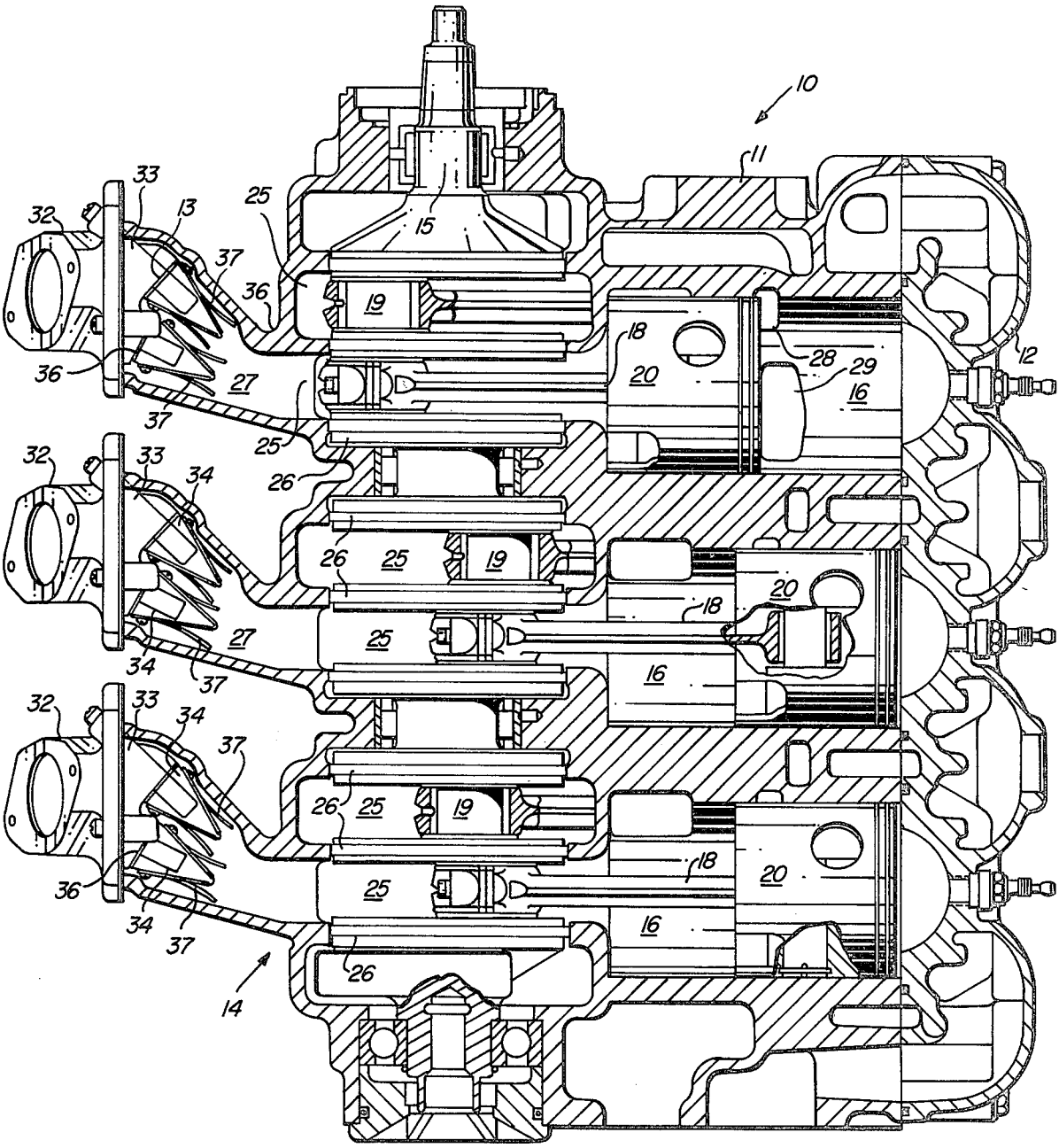
FIG. 3 is a section of the engine taken on line 3—3 of FIG. 2.

The figures illustrate a two-cycle, V-6 engine 10 particularly designed for use in an outboard motor. The engine includes a cylinder block 11 having two cylinder heads 12 and an intake manifold casting 13 defining, with the base or apex of the block, a crankcase 14 within which a crankshaft 15 is rotatably mounted. The cylinder block 11 is sand cast and includes six cylinders 16 arranged in two banks 17 forming a 74° V, the two banks 17 being vertically offset with respect to each other to offset the connecting rods 18. The rods 18 are journalled on crank pins 19 of the crankshaft 15 and pinned to the pistons 20.

The integral sand cast aluminum block 11 has an integrally cast tuned exhaust system including a port extender 21 from the exhaust port 22 of each cylinder 16, the extenders 21 from each cylinder bank 17 connecting to a corresponding exhaust gas chamber 23. The exhaust gas chambers 23 open downwardly, through openings 24 at the bottom of the block 11, and discharge into exhaust passages in the lower unit of the outboard motor, not shown. The engine block 11 is sand cast from aluminum using sand cores. Each exhaust gas chamber 23 and its corresponding port extender passages 21 are formed using a single core. Since operation of the engine 10 generates substantial heat, a water cooling system is provided with cooling passages arranged to provide a relatively even temperature distribution throughout the engine block 11 and cylinder heads 12, as more fully explained in the copending application of the inventor entitled "V-Engine Cooling System Particularly For Outboard Motors", filed on the same day as this application and assigned to the same assignee.

The crankcase 14 is divided into compartments 25, one for each cylinder 16, by the crank disks 26 on the crankshaft 15 which support the crank pins 19. Each compartment 25 is provided with its own inlet passageway 27 to supply air-fuel mixture from carburetors, not shown, to be compressed in the crankcase compartments 25. From the crankcase 14 the air-fuel mixture is directed to the cylinders 16 via the transfer ports 28, 29 and 30, arranged to provide loop scavenging as taught in U.S. Pat. No. 4,092,958 to Hale.

To provide unrestricted flow of air-fuel mixture to the engine an individual inlet passageway 27 is provided for each crankcase compartment 25. Each passageway 27 is rectangular in cross section throughout its length, having a decreasing vertical dimension as it nears the crankcase 14. The increased height of the passageways 27 at the inlet are necessary to accommodate the reed valve assemblies 31.

Carburetor mounting plates 32 are provided at the inlet end of each inlet passageway 27. The mounting plates 32 are angled to support the six carburetors, not shown, in the same plane and to provide a transition from the round carburetor barrels, not shown, to the rectangular inlet passageways 27. Supported by the carburetor mounting plates 32 within the inlet passageways 27 are reed block adaptors 33.

Mounted on each reed block adaptor 33 are two reed valve assemblies 31. Each reed valve assembly 31 has a reed block 34 with two planar outlet faces 35 intersecting to form a triangular section with an open base 36. The outlet faces 35 each include a plurality of ports, not shown, normally closed by reed valves, not shown, which open away from the outlet faces 35 toward the reed stops 37 under reduced pressure in the cranckcase 14, to admit air-fuel mixture from the carburetor to the crankcase 14. Within an inlet passage 27 the reed block adaptor 33 supports the two reed blocks 34 with their outlet faces 35 sloped downward toward the crankcase 14 to prevent accumulations of liquid fuel in the inlets. The two reed blocks 34 are positioned at an angle to each other to minimize the clearance volume of the crankcase, thereby increasing the volumetric efficiency of the crankcase pumping action.

The foregoing inlet manifold system provides a novel and highly effective breathing system for large outboard motor engines.

I claim:

1. A multiple cylinder two-cycle outboard motor engine comprising:

(A) a cylinder block having a plurality of cylinders arranged in two banks forming a V;

(B) a plurality of pistons, one mounted in each of said cylinders;

(C) a crankcase member defining, with said cylinder block, a crankcase;

(D) a crankshaft means supported in said crankcase by said cylinder block and said crankcase member for rotation about a vertical axis, said crankshaft means connecting said pistons for reciprocation in said cylinders and dividing said crankcase into crank chambers, one for each of said cylinders, subject to compression and expansion with the reciprocation of said pistons; and (E) a plurality of inlet passages, one for each of said crank chambers, for admitting an air-fuel mixture to said crank chambers, said inlet passages being arranged in two vertical banks forming a V.

2. The outboard motor engine defined in claim 1 wherein both of said V's are positioned to be bisected by a single plane.

3. The outboard motor engine defined in claim 2 wherein said V formed by said inlet passages has a smaller included angle than said V formed by said cylinder banks.

4. The outboard motor engine defined in claim 1 wherein the lower internal surfaces of each of said inlet passages are sloped downwardly toward said crank chambers.

5. The outboard motor engine defined in claim 4 further comprising:

(F) a plurality of pressure responsive valve means, one positioned in each of said inlet passages, for admitting an air-fuel mixture to said crank chambers during expansion of said crank chambers and for closing during compression of said crank chambers.

6. The outboard motor engine of claim 5 wherein said inlet passages are essentially rectangular in cross-section throughout their length.

7. The outboard motor engine defined in claim 6 wherein said valve means each include a reed valve assembly having a valve block having planar outlet faces and a plurality of valve passages having their outlets in said outlet faces, and (b) a plurality of flexible valve members, one for each of said valve passages, each having one end fixed to one of said outlet faces, said valve members normally closing said valve passages, but responding to reduced pressure in said crank chambers to open.

8. The outboard motor engine defined in claim 7 wherein said planar outlet faces each slope downwardly toward said crank chambers.

9. The outboard motor engine defined in claim 8 wherein each of said pressure responsive valve means includes a pair of said reed valve assemblies.

10. The outboard motor engine defined in claim 9 wherein said reed valve assemblies of a pair are relatively angularly positioned.

* * * * *